US008850845B1

(12) United States Patent
Tucker

(10) Patent No.: US 8,850,845 B1
(45) Date of Patent: Oct. 7, 2014

(54) PORTABLE COOLING UNIT

(76) Inventor: David Wayne Tucker, Sarasota, FL (US)

( * ) Notice: Subject to any disclaimer, the term of this patent is extended or adjusted under 35 U.S.C. 154(b) by 847 days.

(21) Appl. No.: 13/086,388

(22) Filed: Apr. 13, 2011

(51) Int. Cl.

| | |
|---|---|
| ***F25D 19/02*** | (2006.01) |
| ***F25B 9/00*** | (2006.01) |
| ***F04B 17/00*** | (2006.01) |
| ***F04B 35/04*** | (2006.01) |
| ***F04B 17/04*** | (2006.01) |

(52) U.S. Cl.
USPC ..... 62/448; 62/6; 417/415; 417/416; 417/417; 417/418

(58) Field of Classification Search
USPC ..... 62/3.1, 3.3, 6, 498; 415/90; 417/415–418; 92/31, 116, 2
See application file for complete search history.

(56) References Cited

U.S. PATENT DOCUMENTS

| | | | | |
|---|---|---|---|---|
| 4,519,755 | A | 5/1985 | Hanson | |
| 5,209,650 | A | 5/1993 | Lemieux | |
| 5,245,958 | A | 9/1993 | Kreig | |
| 5,885,057 | A * | 3/1999 | Wootten | 415/73 |
| 7,316,551 | B2 | 1/2008 | Bohr | |
| 8,371,134 | B2 * | 2/2013 | Rini et al. | 62/98 |
| 2009/0229280 | A1 | 9/2009 | Doty | |

* cited by examiner

*Primary Examiner* — Brandon M Rosati
*Assistant Examiner* — Elizabeth Martin
(74) *Attorney, Agent, or Firm* — Dorothy S. Morse

(57) ABSTRACT

A portable cooling unit comprising a magnetic spiral vapor pump that utilizes a magnetic pulse between two electromagnets and spiral drive slots to pull a piston back-and-forth 180-degrees and thereby alternately align compression slots on the piston's opposing ends with vapor suction ports and highly-compressed vapor discharge ports. Electromagnet use lowers the amount of battery power required for piston rotation. A condenser in a mounting pan under the pump achieves refrigerant condensation, while a fan blowing air through an evaporator positioned within a flexible hose causes cool air discharge through openings in the hose's terminal end fitting. The condenser utilizes surplus condensation from the evaporator to aid its vapor-to-liquid conversion, and batteries only provide power for the magnetic control module and fan. Applications include, but are not limited to, medical applications and the cooling of small spaces, such as those surrounding children's strollers, play pens, wheel chairs, and pet carriers.

6 Claims, 7 Drawing Sheets

PORTABLE COOLING UNIT

CROSS-REFERENCES TO RELATED APPLICATIONS

None.

BACKGROUND

1. Field of the Invention

This invention relates to cooling systems, specifically to a portable cooling unit using a magnet-driven vapor pump as the compressor portion of its refrigeration cycle, which can be easily transported from one place to another in a carrying bag to provide cooling for small areas and spaces. The vapor pump comprises an oil-filled block assembly, an elongated internal cylinder supported within the block assembly, and an elongated floating piston that is magnet-driven and rotates back-and-forth 180-degrees within the internal cylinder. Pivot points for the rotating piston are preferably single ball bearings which roll along spiral drive slots in the piston, and compression rings associated with the piston isolate compression and discharge functions. Lubrication for the spiral drive slots and bearings is provided by the oil-filled block assembly. The magnet-driven spiral vapor pump is in fluid communication with a condenser, a fixed-orifice metering device, and an evaporator to create the cycle of liquid/vapor phase changes for a refrigerant needed to provide cooled air for delivery to a targeted site, animal, or person. The condenser is positioned within a drain pan, and a fan positioned at one end of a mounting frame supported by drain pan moves air across the condenser and into an air discharge hose containing the evaporator, wherein after becoming cooled by the evaporator as it moves through air passageways therein, the air is directed through a hose terminal end fitting to the targeted area or space in need of cooling. The spiral vapor pump of the present invention has two compression chambers, and a magnetic pulse between electromagnets located at the opposite ends of the spiral vapor pump's block assembly pulls the floating piston so as to align the compression slot on one of its ends with a corresponding intake port in the internal cylinder to draw in vapor from the evaporator for compression, while concurrently aligning the compression slot on the piston's opposing end with a corresponding discharge port in the internal cylinder that releases a high-pressure vapor discharge to condensor coils. When the magnetic pulse rotationally pulls the piston 180-degrees in the opposite direction, the intake and discharge functions for its opposing ends are reversed. The magnetic force applied by the electromagnets to the opposing ends of the block assembly initiates rotational travel of the piston for compression, thus lowering the amount of battery power required for compression. Since batteries are not required to drive piston movement, and are only needed to power the present invention's magnetic control module and fan, battery life in the present invention is significantly extended when compared to prior art portable cooling units, allowing for longer periods of uninterrupted use. Also, portability of the present invention is enhanced, as a large supply of batteries is not required for extended operation. Contemplated applications of the present invention portable cooling unit are varied, and may include but are not limited to, medical applications and the cooling of small spaces, such as those surrounding children's strollers, play pens, wheel chairs, and pet carriers.

2. Description of the Related Art

Prior art portable air conditioning units have many disadvantages. They can be bulky and expensive to purchase, and when they are truly portable and run solely on battery power, they can be heavy to transport and their operating time is often significantly reduced. Yet even with these disadvantages, they are often used to cool infants, small children, the infirm, and caged pets who are not always able to take appropriate action on their own to remain comfortable. Thus, it continues to be desirable to find new ways to cool small spaces, such as those surrounding children's strollers, play pens, wheel chairs, and pet carriers. The simple construction of the present invention lowers cooling cost to the consumer, and the magnet-driven piston rotation occurring in its spiral vapor pump reduces power consumption to provide extended battery life during present invention operation over that currently available in other prior art portable cooling units.

While some prior art pumps have spiral components, no spiral components are known to drive the rotation of a piston back-and-forth 180-degrees for vapor compression. Also, no pump is known to have spiral drive components in combination with piston travel initiated by a magnetic force. A first example is the invention in U.S. Pat. No. 7,316,551 to Bohr (2008), which discloses a rotary vane suction pump with spiral inlet and outlet passages (see components numbered by 350, 352, 360, and 362 in FIGS. 24 and 25). Discs on the ends of its rotor close the ends of the pump chamber and the ends of radially directed slots in which the vanes are seated to form fluid cavities. In contrast, the structure of the present invention is different from that found in the Bohr invention, as its portable cooling unit does not have spiral inlet and outlet passages for the suction and discharge of fluid. Instead, pivot points for the back-and-forth 180-degree rotation of the present invention piston include spiral drive slots. In addition, a pump disclosed in U.S. Pat. No. 4,519,755 to Hanson (1985) has spiral paths for lubrication fluid travel into, and out of, its compression chambers for sealing purposes. The Hanson pump has an inner gear-type rotor mounted on a drive shaft which is off-center within an outer gear-type rotor (see column 2, lines 64-68). As the inner rotor is turned by an electric motor, intermeshing of rotor teeth causes the outer rotor to rotate within a rotor chamber. Since the inner rotor has one less gear tooth than the outer rotor, a pumping chamber is formed between each pair of rotor teeth. Oil enters the pumping chamber through the inlet port at one end of the pumping chamber, and exits through the outlet port at the other end of the same pumping chamber, thereby following a generally spiral path through the rotor assembly while it provides lubrication and sealing (see column 3, lines 55-61). In contrast, the structure of the present invention is very different from that found in the Hanson invention, as the spiral configuration in the present invention relates to spiral drive slots that provide pivot points for the back-and-forth 180-degree rotation of an elongated floating piston located within an internal cylinder, both of which are housed within an oil-filled block assembly, and its spiral features do not communicate with its "pumping chambers". Furthermore, although spiral features are also found in other inventions, such as the invention in U.S. Pat. No. 5,209,650 to Lemieux (1993) which has spiral paths for introducing a liquid film to a shaft, the invention in U.S. in Pre-Grant Publication 2009/0229280 to Doty (2009) which discloses a spiral passageway that allows liquid refrigerant to cool a stator (see paragraph [0101]), and the invention in U.S. Pat. No. 5,245,958 to Krieg (1993) which has spiral grooves in a cylinder for venting purposes, none uses spiral drive slots as pivot points for rotation back-and-forth 180-degrees or has piston rotation that is magnet-driven. Thus, no other portable cooling unit is currently known with a vapor pump that functions in the same manner as the magnet-driven spiral-compression vapor pump of the present invention, or otherwise has a construction similar to that of the present invention portable cooling unit, or provides all of its features and advantages.

BRIEF SUMMARY OF THE INVENTION

It is the primary object of this invention to provide a portable cooling unit that lowers cooling cost to the consumer as a result of its simple design and reduced power consumption that extends battery life. It is also an object of this invention to provide a cooling unit with lightweight materials and compact construction for enhanced portability. A further object of this invention is to provide a portable cooling unit having rugged and durable construction that facilitates movement from one location to another, minimizes damage to components during travel and storage, and enhances operational reliability. Another object of this invention is to provide a portable cooling unit made from materials that are strong, impact resistant, heat resistant, non-flammable, impervious to corrosion, and unaffected by extreme ambient temperature fluctuations during extended use. It is also an object of this invention to provide a portable cooling unit with a variety of air diffusing options for directing air to a targeted area or space in need of cooling. A further object of this invention is to provide a portable cooling unit configured to have condensation from its evaporator utilized by its condensor as an aid for vapor-to-liquid conversion.

The present invention, when properly made and used, provides a battery-operated portable cooling unit for small spaces that comprises a magnet-driven spiral vapor pump as the compressor portion of its refrigeration cycle. The pump utilizes a magnetic pulse between two electromagnets to rotatingly pull an elongated floating piston back-and-forth 180-degrees on spiral drive slots, aligning a compression slot on one end of the piston with a vapor inlet port to create suction on that end, while concurrently aligning an independent compression slot on the second end of the piston with a discharge port to create a high-pressure vapor discharge at the piston's second end. When the piston is pulled through a 180-degree rotation by the magnetic pulse in the opposite direction, the intake and discharge functions for its opposing ends are reversed. Electromagnet use lowers the amount of battery power required for vapor compression (requiring only the amount needed to operate the magnetic control module and a fan), and allows the present invention cooling unit to be employed for extended periods of time, significantly beyond that currently possible with prior art portable cooling units operating solely on battery power. An oil-filled block assembly houses the piston, as well as the internal cylinder in which the back-and-forth piston rotation occurs, and magnetic force applied to the ends of the block assembly via electromagnet assemblies initiates the piston travel that causes vapor compression and the subsequent discharge of highly-compressed vapor into the condenser alternately from the opposing ends of block assembly. Pivot points for the rotating piston are preferably single ball bearings which roll along the piston's spiral drive slots, and compression rings associated with the piston isolate both of its compression chambers from one another. The spiral vapor pump contains refrigerant in its vapor phase, and is connected via a pump discharge line to a condenser situated in a drain pan positioned under the spiral vapor pump. A fan mounted on one end of the drain pan blows air across the condenser to assist in the vapor-to-liquid change of the high-pressure compressed vapor leaving the spiral vapor pump, which then travels through a fixed-orifice metering device, and thereafter travels through an evaporator positioned within a flexible hose. Concurrent with the liquid/vapor phase changes of the refrigerant, the same fan forcing air across the condenser also forces air into the flexible hose and through air passageways in the evaporator. During the evaporation process that cools the air forced by the fan through the evaporator, liquid refrigerant also traveling through the evaporator within a sealed coolant line absorbs heat from the fan-forced air and is changed into a vapor, which is then directed back to the spiral vapor pump for further compression, condensation, and evaporation cycles. Discharge of cooled air from the distal end of the flexible hose occurs through vents in a hose terminal end fitting. An optional rotating cuff may also be associated with the hose's terminal end fitting for directional air movement. The condenser also utilizes surplus condensation from the evaporator as an aid for the vapor-to-liquid conversion (it drips through a hole in the air delivery tube downwardly into the drain pan). Thus, the present invention provides a portable cooling unit with simple, compact, and durable construction for reliable operation during extended periods of time. It is also intended for the materials used for its components to be strong, lightweight (to the extent possible to remain durable and impact resistant), heat resistant, non-flammable, impervious to corrosion, unaffected by extreme ambient temperature fluctuations during extended use, and/or otherwise suitable for proper and safe operation of the portable cooling unit. Furthermore, in addition to the variety of hose terminal end fittings usable with the present invention air discharge hose (such as but not limited to a straight tube with elongated slots, or a Y-shaped tube), a variety of air diffusing cuffs each having a different size and/or configuration (such as but not limited to cuffs with directional air vents and/or rotation capability), can be associated with the present invention's hose terminal end fitting for directional air discharge, and/or other advantageous capability needed in the intended cooling application for which the present invention portable cooling unit is used.

It is intended herein for the invention description to provide preferred embodiments of the present invention, and should not be construed as limiting to its scope. For example, variations in the overall size of the floating piston, internal cylinder, and block assembly are possible as long as they remain in proper proportion to one another for effective and efficient vapor compression; as well as variations in the diameter dimension of the arcuate/spiral drive slots in the piston; the size of the ports in the block assembly; the number, size, and shape of air holes through optional air-diffusing cuffs associated with the hose terminal end fitting; the thickness dimensions of the head plates; the type and size of evaporator used; the number, size, shape, and placement of fastener holes used for assembly of the spiral pump housing and gaskets around the internal cylinder; the size, number, and dimensions of the electromagnets used with the block assembly; and the size and number of batteries used, other than those shown and described herein, may be incorporated into the present invention. Thus, the scope of the present invention should be determined by the appended claims and their legal equivalents, rather than being limited to the examples given herein.

COMPONENT LIST

Figure 1:
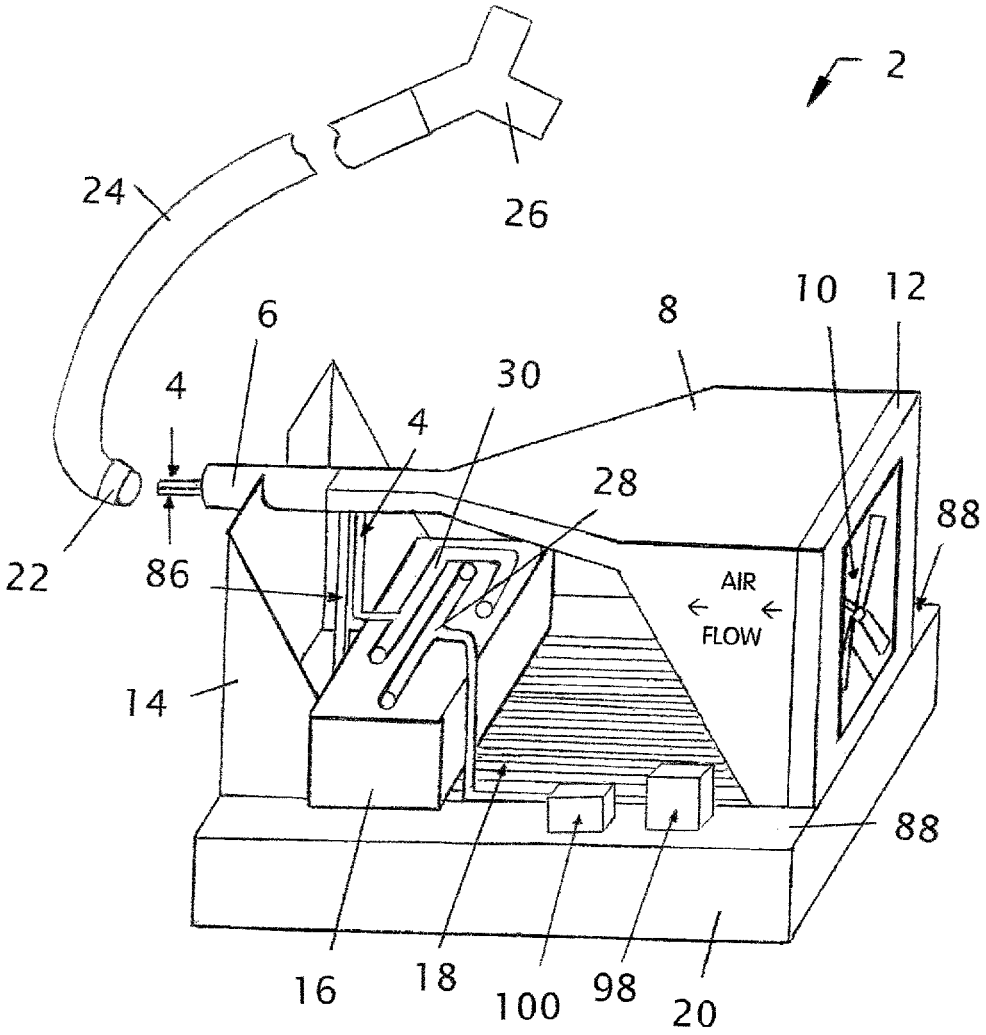
FIG. 1 is a perspective view of the most preferred embodiment of the present invention portable cooling unit ready for connection to an air discharge hose with a Y-shaped terminal fitting, and shows a drain pan supporting a condenser, a mounting frame supported by the drain pan, a fan secured to one end of the mounting frame and directing air flow toward the air discharge hose (which houses an evaporator that is hidden from view), a fan housing supporting the fan, a battery pack and a magnetic control module each supported on a shelf on the near side of the drain pan, and a spiral vapor pump supported by the mounting frame and drain pan with refrigerant lines connecting it to the adjacent condenser, as well as the evaporator hidden within the air discharge hose.

2—Portable Cooling Unit
4—Vapor Return Line (for travel of refrigerant from evaporator 31 to spiral vapor pump 16, such as but not limited to Freon)
6—Air Delivery Tube (supported by blower support 14)
8—Fan Housing (Plenum) (supported by mounting frame and drain pan 20)
10—Fan Assembly (supported by fan mounting 12)
12—Fan Mounting (supported by mounting frame and drain pan 20)
14—Blower Support (supported by mounting frame and drain pan 20)
16—Spiral Vapor Pump (supported by mounting frame and drain pan 20)
18—Condenser (supported by mounting frame and drain pan 20)
20—Mounting Frame and Drain Pan (includes a shelf 88 on each of its sides)
22—Metering Device (Fixed-Orifice)
24—Air Discharge Hose (used as a part of the evaporator section of portable cooling unit 2 to deliver cooled air to a targeted space or location)
26—Y-shaped Hose End Fitting (for use with air discharge hose 24)
28—Pump Discharge Line (positioned between pump 16 and condenser 18)
30—Pump Suction Line (positioned between evaporator 32 and pump 16)
32—Ring Fin Evaporator
34—Air Passageway (in evaporator 32)
36—Spiral Pump Housing (oil-filled for lubrication of spiral drive slots 62, also referred to as "block assembly")
38—Cylinder Housing (preferably aluminum)
40—Cover Plate (preferably aluminum)
42—Gasket
44—Head Plate
46—Magnet Assembly
48—Electrical Wiring (for connection of magnet assembly 46 to magnetic control module 100)
50—Discharge Outlet Holes
52—Fastener Holes
54—Suction Inlet Holes
56—Drive Access Holes
58—Piston (made from material with magnetic properties, preferably steel)
60—Compression Ring (associated with piston 58)
62—Spiral Drive Slot
64—Compression Slot
66—Internal Cylinder (preferably aluminum)
68—Intake port
70—Discharge port
72—Drive port
74—Drive Cover
76—Drive Spring
78—Drive Ball
80—Hose Adapter (used for connection of evaporator housing 82 to air discharge tube 90)
82—Evaporator Housing (part of evaporator 32)
84—Ring Fin Construction (part of evaporator 32)
86—Liquid Inlet Line (for refrigerant travel to evaporator 32 from condenser 18)
88—Shelf (present on both sides of mounting frame and drain pan 20)
90—Air Discharge Tube (a hose terminal end fitting with one closed end 102 that is secured to the distal end of the air discharge hose 24 in the evaporator section of portable cooling unit 2 for delivery of cooled air to a targeted site or location)
92—Slot vents (employed for travel of air through air discharge tube 94 to a user)

94—Rotatable Cuff (a tubular hose termination fitting usable over air discharge tube 90)

96—Directional Air Vents (used for directional travel of air from rotatable cuff 90)

98—Battery or Battery Pack (preferably supported by shelf 88)

100—Magnetic Control Module (preferably containing a variable speed motor, and also preferably supported by shelf 88)

102—Closed End (of air discharge tube 90)

DETAILED DESCRIPTION OF PREFERRED EMBODIMENTS

Figures 2, 2A:
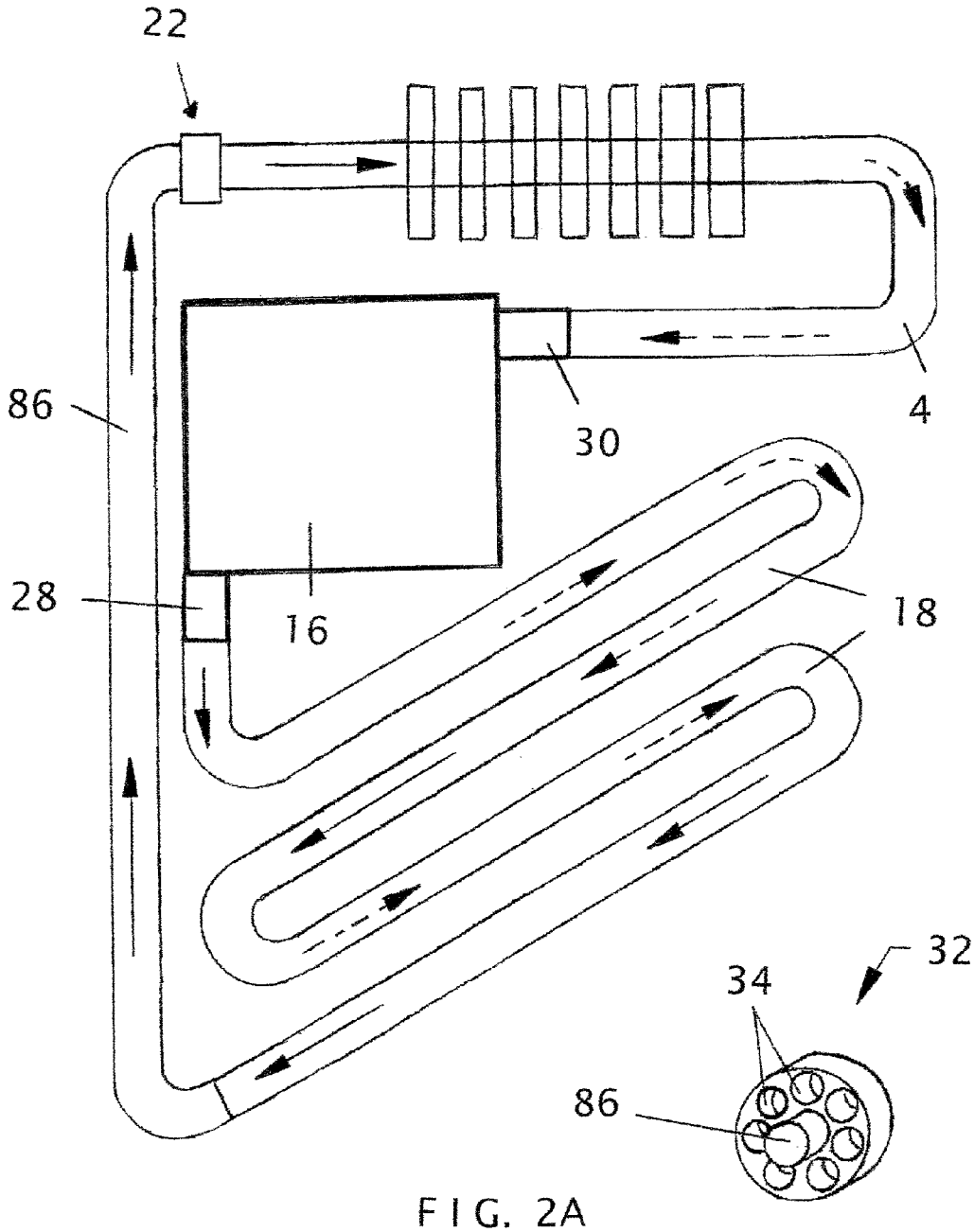
FIG. 2 is a schematic view of the liquid/vapor circuit for the refrigerant used as a part of the most preferred embodiment of the present invention, with broken lines showing the refrigerant in a vapor phase, and solid lines showing the refrigerant primarily as a liquid.
FIG. 2A is an end view of the evaporator in FIG. 2, showing its centrally located refrigerant liquid line and surrounding air passageways.
Figure 3:
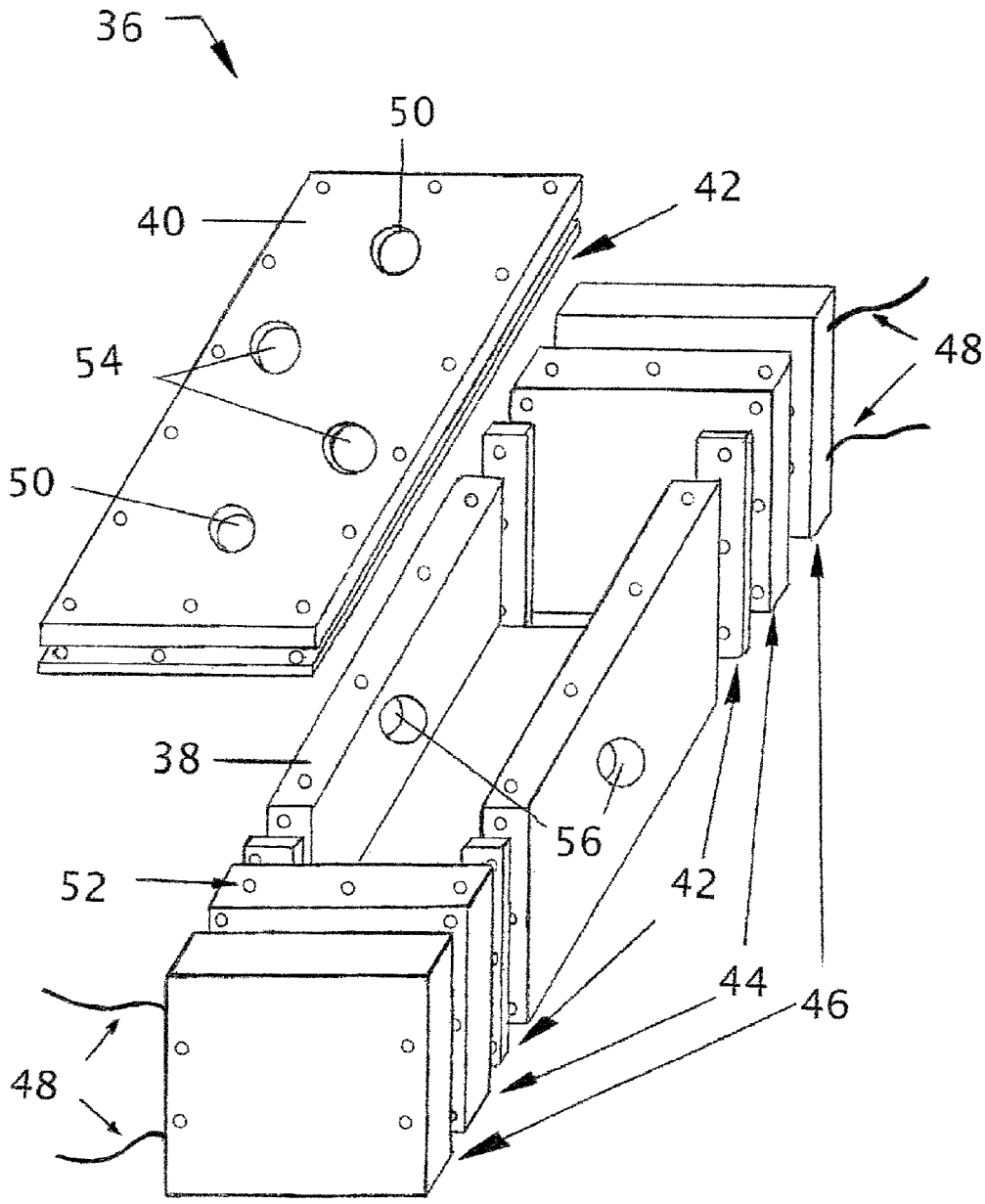
FIG. 3 is a perspective view of the spiral pump housing (also referred to as "block assembly") that is used as a part of the most preferred embodiment of the present invention portable cooling unit, which shows a U-shaped housing with two side drive access holes in opposed positions from one another, a cover plate and gasket each with two centrally-located suction inlet holes and two discharge outlet holes situated remotely from one another in positions closer to the cover plate's and gasket's opposing ends, two head plates each with associated gasket material, and each head plate associated with a different magnet assembly having means for electrical connection to the magnetic control module shown in FIG. 1.

The present invention is a battery-operated portable cooling unit 2 that incorporates a magnet-driven spiral vapor pump 16 as the compressor portion of its refrigeration cycle. In its most preferred embodiment, spiral vapor pump 16 comprises a block assembly 36 which houses a floating piston 58 that rotates back-and-forth 180-degrees within an internal cylinder 66 using spiral drive slots 62 (in piston 58) and drive ports 72 (in internal cylinder 66), in combination with the drive ball 78, drive spring 76, and threaded drive cover 74 associated with each paired drive slot 62 and drive port 72 (see FIG. 5A). In addition to its spiral vapor pump 16, the present invention portable cooling unit 2 also comprises a condenser 18, a fan 10, and an evaporator 32 positioned within an air discharge hose 24 (and hidden from view in FIG. 1) that delivers cooled air (not shown) to a targeted area or space in need of cooling. A magnetic pulse between electromagnets 46 positioned at the opposite ends of the block assembly 36 pulls the floating piston 58 to rotate 180-degrees and align the compression slot 64 near one of its ends with a corresponding intake port 68 in the internal cylinder assembly 66 and thus draw in vapor from evaporator 32 into that end of spiral vapor pump 16 for compression (vapor is depicted in FIG. 2 by two broken-line arrows positioned within vapor return line 4), while concurrently aligning the compression slot 64 on the piston's 58 opposing second end with a corresponding discharge port 70 in the internal cylinder assembly 66 that releases a highly-compressed vapor discharge to condensor 18 coils (also depicted in FIG. 2 by several broken-line arrows, and in contrast, liquid refrigerant leaving condenser 18 is depicted by solid lines). When the magnetic pulse between electromagnets 46 pulls floating piston 58 in the opposite direction 180-degrees, the intake and discharge functions for the opposing ends of spiral vapor pump 16 are reversed. The use of electromagnets 46 (which initiates piston 58 travel for compression) lowers the amount of battery 98 power required for compression. Thus, since batteries or a battery pack 98 are only needed to power the present invention's magnetic control module 100 and fan 10, the weight of cooling unit 2 is reduced (enhancing portability) and its operating time is also extended. Pivot points for the floating piston 58 are preferably single ball bearings 78 which roll along the piston's arcuate/spiral drive slots 62, and compression rings 60 associated with piston 58 isolate compression and discharge chambers. Furthermore, the present invention's condenser 18 is positioned within a mounting pan 20 under the fan housing 8 (plenum) and receives the high-pressure vapor discharge (shown by broken-line arrows in FIG. 2) from the spiral vapor pump 16, while the fan 10 supported by fan mount 12 moves air (not shown) across condenser 18 coils that assists in the vapor-to-liquid phase change of the high-pressure vapor discharge of refrigerant from spiral vapor pump 16 as it moves through condenser 18. The liquid refrigerant (shown by solid arrows in FIG. 2) then moves through a fixed-orifice metering device 22 and through air passageways 34 in the evaporator 32 positioned within an air discharge hose 24, where the refrigerant undergoes another phase change back into a vapor. Evaporation of the refrigerant takes heat from air directed by fan 10 through the multiple air passageways 34 in evaporator 32 that are situated around its centrally-located liquid inlet line 86. The condenser 18 utilizes surplus condensation from evaporator 32 as an aid for vapor-to-liquid conversion, which drips into mounting frame and drain pan 20 via at least one small hole (not shown) formed through the underside portion of air delivery tube 6. The cooled air leaving evaporator 32 then travels through vents 96 in a terminal end fitting/tube (26, 90, 94, and/or other) attached to the distal end of the air discharge hose 24 and is delivered to the targeted area or space in need of cooling. A rotatable cuff 94 with directional air vents 92 may be used with the terminal hose fitting 90, as needed by the intended application to direct or otherwise adjust air flow. Contemplated applications of the present invention are varied, and may include but are not limited to, medical applications and the cooling of small spaces, such as those surrounding children's strollers, play pens, wheel chairs, and pet carriers. FIG. 1 shows the most preferred embodiment of the present invention portable cooling unit 2, while FIG. 2 shows the preferred liquid/vapor circuit for refrigerant used as a part of the most preferred embodiment of the present invention. In addition, FIGS. 6 and 2A show enlarged views of the most preferred structure for evaporator 32. Also, FIG. 3 shows the block assembly 36 used as a part of the most preferred embodiment of the present invention for its spiral vapor pump 16, while FIGS. 4 and 5 respectively illustrate the piston 58 and internal cylinder 66 used as internal components of the spiral vapor pump 16 in the most preferred embodiment of the present invention. Furthermore, FIG. 5A shows the combined drive ball 78, drive spring 76, and threaded drive cover 74 associated with each partially-threaded drive port 72 of the internal cylinder 66 in the most preferred embodiment of portable cooling unit 2, while FIGS. 7 and 8 each show a different hose terminal end fitting usable with air discharge hose 24.

FIG. 1 is a not-to-scale perspective view of the most preferred embodiment of the present invention portable cooling unit 2, with an air discharge hose 24 having an attached Y-shaped end fitting 26 ready for connection to air delivery tube 6. Although hidden from view in FIG. 1, an evaporator 32 is located within air discharge hose 24. The liquid inlet line 86 and vapor return line 4 for refrigerant shown extending from air delivery tube 6 in FIG. 1, are for connection to evaporator 32 (shown in FIGS. 2, 2A, and 6). A fixed-orifice metering device 22 is shown connected to the proximal end of air discharge hose 24. The length of air discharge hose 24 can vary in differing applications, and is not limited to that shown in FIG. 1. Also, the Y-shaped end fitting 26 attached to the distal end of air discharge hose 24 is used only as one example of end fitting usable with portable cooling unit 2. Although not limited to the hose end fittings shown and described herein, other examples of end fittings usable with air discharge hose 24 can be seen in FIGS. 7 and 8. FIG. 1 shows spiral vapor pump 16 as a central part of portable cooling unit 2, supported on a mounting frame and drain pan 20 which holds condenser 18, with a portion of the fan housing 8 (plenum) and the air delivery tube 6 located between fan housing 8 and air discharge hose 24 both situated in positions above spiral vapor pump 16. The size and shape of fan housing 8 shown in FIG. 1 is not critical, as long as the fan assembly 10 positioned within the fan mounting 12 at the air intake end of fan housing 8 can cause sufficient air to pass over the coils of condenser 18 to achieve the needed phase change of circulated refrigerant from vapor to liquid. Although not shown, a hole or holes in air delivery tube 6 allows surplus condensation from an evaporator 32 positioned within air discharge hose 24 (hidden from view in FIG. 1) to drain from air delivery tube 6 into mounting frame and drain pan 20, where the condensation aids in the vapor-to-liquid phase conversion of refrigerant being pumped through condenser 18. FIG. 1 further shows a pump discharge line 28 (attached to both discharge ports 70 of internal cylinder 66) positioned between spiral vapor pump 16 and condenser 18 through which very highly-compressed refrigerant vapor is pumped into condenser 18 for conversion to a liquid, as well as the liquid refrigerant line 86 extending between condenser 18 and a fixed-orifice metering device 22 leading to the evaporator 32 positioned within air discharge hose 24. FIG. 1 then shows a refrigerant line 4 containing vapor (marked by arrows in FIG. 2) extending from evaporator 32 (hidden within air discharge hose 24) that is connected to the pump suction line 30 attached to both intake ports 68 of the internal cylinder 66 within spiral vapor pump 16. A blower support 14 is also shown in FIG. 1 upon mounting frame and drain pan 20 and positioned remotely from fan 10, which cradles a portion of air delivery tube 6 to maintain it in a fixed position and orientation above spiral vapor pump 16. In addition, FIG. 1 shows a battery or battery pack 98 and a magnetic control module 100 positioned on a shelf 88 formed by the extension of one or both sides of mounting frame and drain pan 20 beyond fan housing 8, blower support 14, and spiral vapor pump 16. Although not limited thereto, magnetic control module 100 may comprise a small variable speed motor. The small and simplistic cubed representation used to illustrate battery 98 and magnetic control module 100 are not intended to be representative of their size, shape, or relative dimension to one another (or to portable cooling unit 2). Also, although not shown, during use of portable cooling unit 2 electrical wiring would be connected between battery 98 and fan 10, battery 98 and magnetic control unit 100, and between magnetic control unit 10 and each of the magnet assemblies 46 used to rotatively pull piston 58 during its back-and-forth 180-degree rotations. Although not shown, for ease in portability the cooling unit 2 of the present invention may be used with a carrying bag, the only structural limitation of which is that it should be sufficiently large for convenient handling and transport of portable cooling unit 2. Also, although not shown in FIG. 1 and not limited thereto, it is preferred for the piston 58 of the most preferred embodiment of the present invention portable cooling unit 2 to be made from steel, and for its cylinder housing 38 and internal cylinder 66 to both be made from aluminum. Furthermore, although not limited thereto, in the most preferred embodiment of cooling unit 2 disclosed herein, it is contemplated for liquid and suction lines to be made from flexible braided steel.

FIG. 2 is a schematic view of the liquid/vapor circuit for refrigerant used as a part of the most preferred embodiment of portable cooling unit 2. Travel of refrigerant is shown by arrows, with its vapor phase marked in broken lines and its liquid phase marked in solid lines. Vapor from evaporator 32 at the top of the schematic diagram travels through the refrigerant vapor return line 4, and then through the pump suction line 30 attached to spiral vapor pump 16. Once in spiral vapor pump 16, the vapor is compressed and leaves spiral vapor pump 16 as a very highly-compressed heated vapor discharge that travels through pump discharge line 28 to condensor 18. The configurations and relative length dimensions of pump discharge line 28 and pump suction line 30, as compared to one another and to spiral vapor pump 16, should not be considered as limiting. Once the refrigerant vapor is positioned within condenser 18, its coils cool the vapor and convert it into a liquid, which then travels through refrigerant liquid inlet line 86 to a fixed-orifice metering device 22. Once the refrigerant travels beyond the metering device 22, it moves through the evaporator 32 (which is housed within air discharge hose 24). Air warmed by the condensor's 18 coils also travels into air discharge hose 24 and through air passageways 34 within evaporator 32 that surround the centrally-located refrigerant liquid inlet line 86, causing the refrigerant in liquid inlet line 86 to change into a vapor. As a result of the heat loss used in the liquid/vapor conversion of refrigerant occurring within evaporator 32, the air moving within air discharge hose 24 beyond evaporator 32 is cooled and can be directed to a targeted space in need of cooling. Once the refrigerant vapor leaves evaporator 32 via refrigerant vapor return line 4, it is transported back to spiral vapor pump 16 for another compression event. FIG. 2A is an end view of the evaporator 32 shown in FIG. 2, which reveals the centrally-located liquid inlet line 86 for refrigerant entering evaporator 32, and the multiple air passageways 34 through evaporator 32 that are positioned around liquid inlet line 86 and allow air traveling through evaporator 32 to become cooled. The evaporator 32 contemplated for use in the most preferred embodiment of the present invention portable cooling unit 2 is shown in more detail in FIG. 6.

FIG. 3 is a perspective view of the block assembly 36 used as a part of spiral vapor pump 16 in the most preferred embodiment of portable cooling unit 2. Block assembly 36 houses piston 58 and the associated internal cylinder 66 in which piston 58 rotates. Although not shown in FIG. 3, it is contemplated that during its use, block assembly 36 will be oil-filled for cooling and lubricating the drive slots 62 in piston 58 (see FIG. 4). FIG. 3 shows block assembly 36 having a U-shaped cylinder housing 38 (preferably made from lightweight material such as aluminum, but not limited thereto) having two side drive access holes 56 located in opposed positions from one another. The drive ports 72 shown in FIG. 5 would each extend through a different one of the drive access holes 56 when internal cylinder 66 is in its position of use within block assembly 36. FIG. 3 further shows a cover plate 40 and gasket material 42 each with two suction inlet holes 54 and two discharge outlet holes 50, and multiple fastener holes 56 through cover plate 40, gasket material 42 and the U-shaped cylinder housing 38 that are used to secure all of them together around piston 58 and internal cylinder 66. When internal cylinder 66 is positioned within block assembly 36, a different intake port 68 on internal cylinder 66 would extend through each suction inlet hole 54 (for connection to pump suction line 30, and a different discharge port 70 on internal cylinder 66 would extend through each discharge outlet hole 50 (for connection to pump discharge line 28). In addition, FIG. 3 shows two head plates 44 each with associated gasket material 42, that are used between a magnet assembly 46 and the U-shaped cylinder housing 38 to close a different one of its ends. Fastener holes 52 are shown in head plates 44, gasket material 42, magnet assemblies 46, and U-shaped cylinder housing 38, which allow secure connection of block assembly 36 components to one another. Fasteners to be used with fastener holes 52 are not considered distinctive, and are not illustrated in FIG. 3. Thus, any fastener dimensioned and configured to make a secure connection between block assembly 36 components during extended periods of time is contemplated for use as a part of the most preferred embodiment of portable cooling unit 2. FIG. 3 also shows magnet assemblies 46 having electrical wiring 48 that connects them to magnetic control module 100 (shown in representative form in FIG. 1). Although the configuration of block assembly 36 shown in FIG. 3 is contemplated for use as a part of the most preferred embodiment of portable cooling unit 2, variations from that shown are considered to be within the scope of the present invention, including but not limited to a change in the positioning of discharge outlet holes 50 and suction inlet holes 54; the number, size, configuration, positioning, and spaced-apart distance between fastener holes 52; the number of gaskets 42 used; and the number of electromagnets used in magnet assemblies 46.

Figure 4:
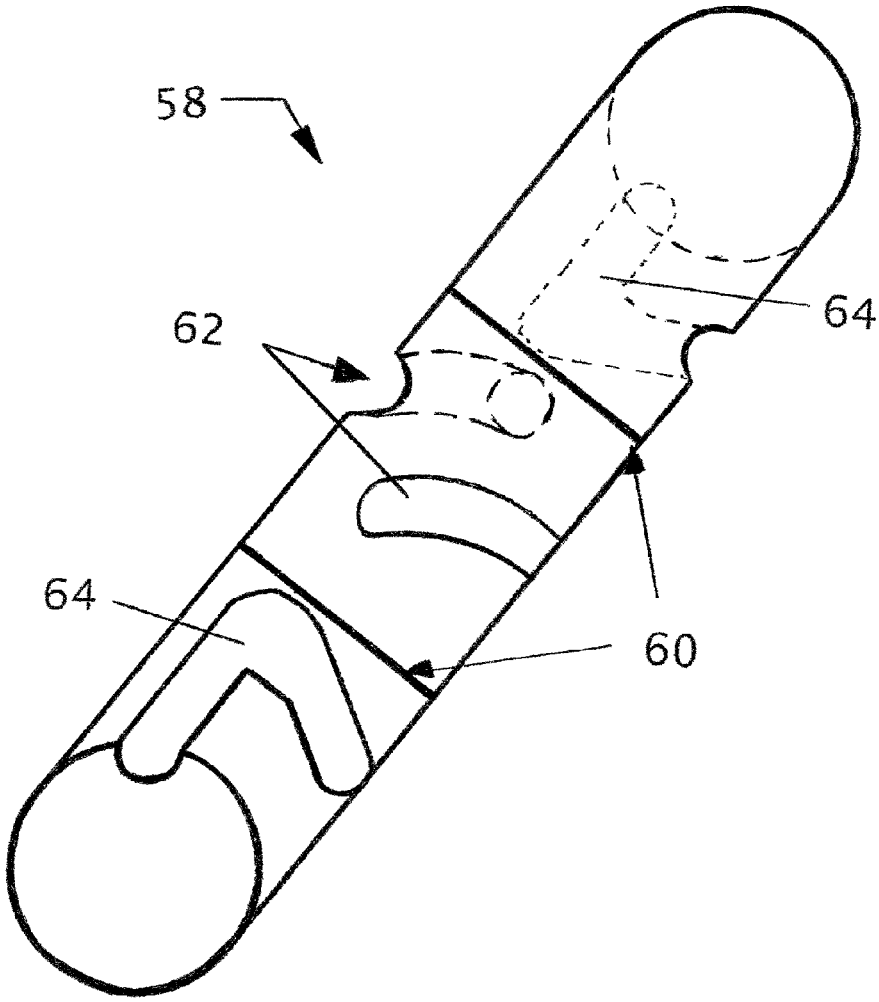
FIG. 4 is a perspective view of the piston used as a part of the most preferred embodiment of the present invention that shows two centrally-located spiral drive slots, an independent compression slot located adjacent to each of its ends, and preferred positioning of compression rings that isolate the two compression chambers from one another.
Figure 5:
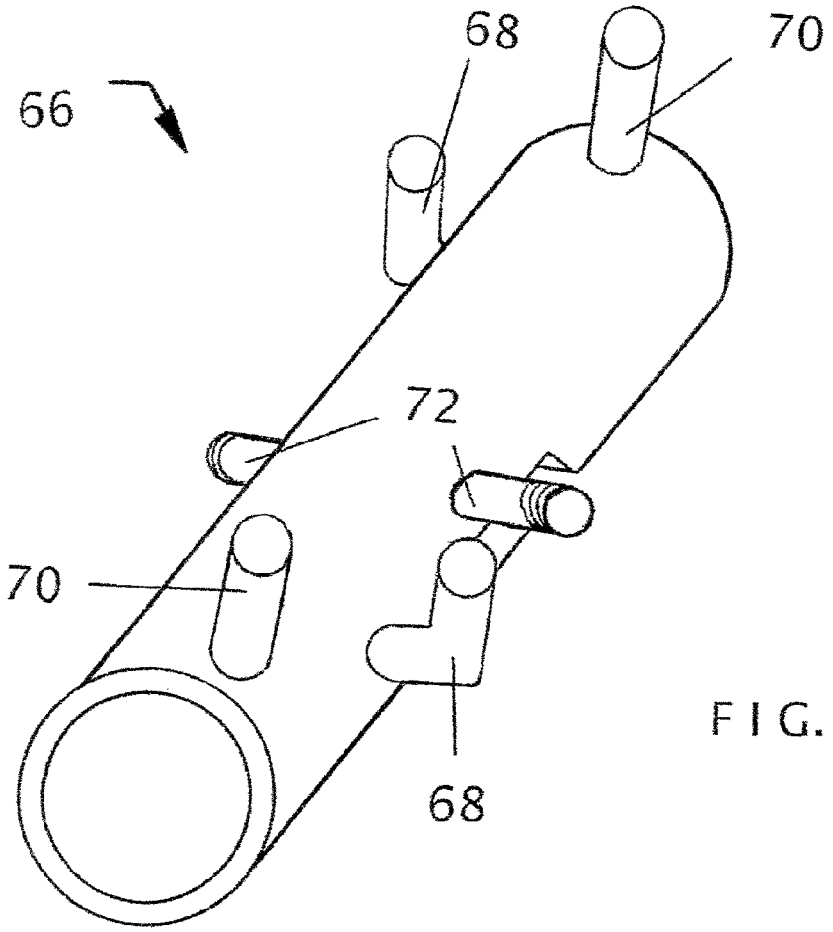
FIG. 5 is a perspective view of the internal cylinder used as a part of the spiral vapor pump in the most preferred embodiment of the present invention portable cooling unit, and having two partially-threaded central drive ports extending outwardly from the sides of the internal cylinder in opposing directions from one another, two discharge ports each located near a different end of the internal cylinder, and two intake ports each located between a different one of the discharge ports and the partially-threaded central drive ports.
Figure 5A:
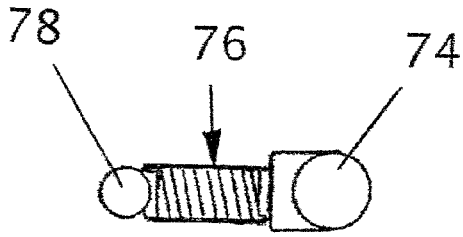
FIG. 5A is a side view of a drive ball, drive spring, and threaded drive cover that can be used with each of the drive ports in the internal cylinder shown in FIG. 5 during piston rotation.
Figure 6:
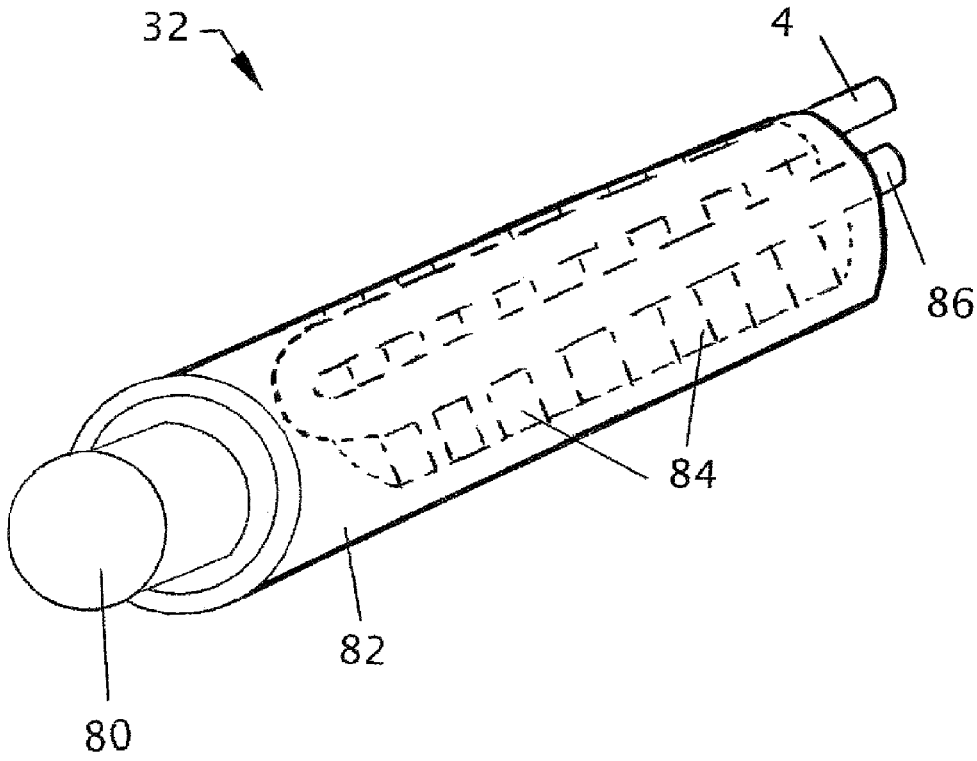
FIG. 6 is a perspective view of the ring fin evaporator used as a part of the most preferred embodiment of the present invention and shows its housing, hose adapter, centrally-positioned liquid inlet line, and vapor return line that carries vapor back to the spiral vapor pump for another compression event.

FIGS. 4, 5, and 5A show the spiral vapor pump 16 components associated with block assembly 36. FIG. 4 is a perspective view of piston 58 that is used as a part of the most preferred embodiment of portable cooling unit 2, which shows piston 58 having one compression slot 64 on each of its ends (one hidden from view and shown in broken lines), two centrally-located spiral drive slots 62 (one hidden from view and shown in broken lines), and preferred locations for compression rings 60 that are used to isolate the piston's 58 two compression chambers from one another. The locations shown for compression slots 64 and drive slot 62 are preferred, but not critical. Most dimension and configuration changes made from that shown in FIG. 4 would require a corresponding change to internal cylinder 66. FIG. 5 is a perspective view of the internal cylinder 66 used as a part of the most preferred embodiment of spiral vapor pump 16. FIG. 5 shows two partially-threaded drive ports 72 extending outwardly from the center of internal cylinder 66 in opposed positions from one another, two intake ports 68, and two discharge ports 70, while FIG. 5A shows preferred configurations of the drive ball 78, drive spring 76, and threaded drive cover 74 combination used with each of the drive ports 72 in the most preferred embodiment of portable cooling unit 2. The locations shown in FIG. 5 for intake ports 68 and discharge ports 70 are preferred, but not critical. However, they would need to complement locations shown in FIG. 4 for compression slots 64 to achieve needed compression and discharge of very highly-compressed and heated refrigerant vapor. Although piston 58 and internal cylinder 66 are not shown together in the same illustration for one to draw conclusions about their relative sizes, it is contemplated for piston 58 to be slightly smaller than internal cylinder 66, but substantially filling it, while leaving enough space within internal cylinder 66 for the free/floating rotation of piston 58 and end areas/chambers (between each compression ring 60 and the adjacent end of piston 58) where vapor compression can occur.

FIG. 6 is a perspective view of the evaporator 32 contemplated for use as a part of the most preferred embodiment of the present invention portable cooling unit 2. FIG. 2A also shows an end view of evaporator 32. FIG. 6 shows a hose adapter 80 connected to one end of evaporator housing 82, and ring fin construction 84 that enables liquid-to-vapor conversion of refrigerant passing through evaporator 32 that results in a cooling of air traveling through the multiple air passageways 34 (shown in FIG. 2A) in evaporator 32. FIGS. 2A and 6 both show the liquid inlet line 86 connected to condenser 18 centrally positioned within evaporator 32, and FIG. 6 also shows the vapor return line 4 that allows travel of refrigerant vapor back to spiral vapor pump 16 for another compression event. Although an evaporator 32 with a ring fin construction 84 is preferred, use of other evaporators as a part of the present invention is also contemplated.

Figure 7:
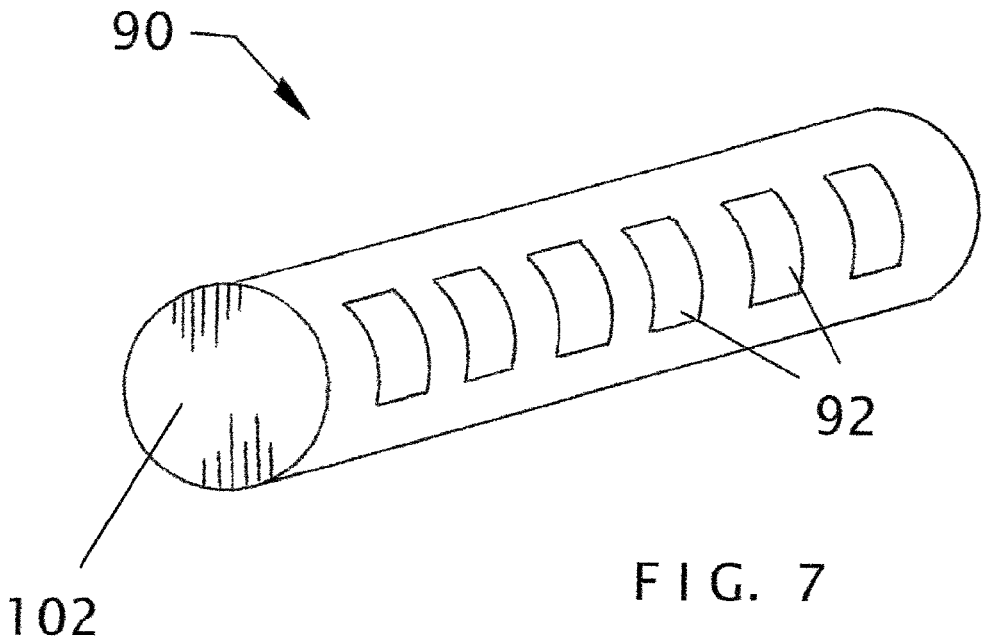
FIG. 7 is a perspective view of a hose terminal end fitting that can be employed with the air discharge hose in the most preferred embodiment of the present invention, showing a closed end and elongated air discharge slots that deliver cooled air to a targeted space or location.
Figure 8:
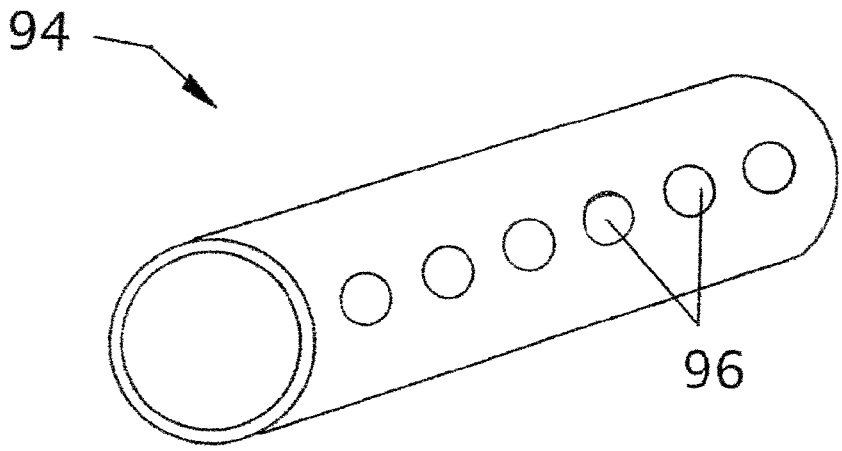
FIG. 8 is a perspective view of an open-ended and generally tubular rotatable cuff having aligned air vents that can be used with the hose terminal end fitting in FIG. 7 to provide adjustable air flow from air discharge hose.

FIGS. 7 and 8 both show hose terminal end fittings usable with the distal end of air discharge hose 24 which are configured to deliver cooled air to a targeted area or location. FIG. 7 is a side view of a hose terminal end fitting in the form of an air discharge tube 90. It has a closed distal end 102 and is attached to the air discharge hose 24 of the most preferred embodiment of portable cooling unit 2 to deliver cooled air (not shown) to a user. Multiple elongated slot vents 92 are present through the near side of air discharge tube 90, each of which is fixed in size. Similar elongated slot vents 92 may also be present through the reverse (hidden) side of air discharge tube 90. The size, configuration, number, and spaced-apart distance between adjacent slot vents 92 may be different from the shown. Also, although not shown, slot vents 92 may be adapted for partial closure (or for part of them to be temporarily blocked according to user need). In contrast, FIG. 8 is a perspective view of an open-ended and generally tubular rotatable cuff 94 with aligned/directional air vents 96 that can be used with the air discharge tube 90 shown in FIG. 7 to provide directional or adjustable air flow to a user. Alternatively, although not shown, one end of rotatable cuff 94 can be sealed. The diameter dimension of rotatable cuff 94 is contemplated to be slightly larger than that of air discharge tube 90, so that free rotation of cuff 94 around air discharge tube 90 can occur for adjustment of air flow from air discharge hose 24 according to need. The size, configuration, number, and spaced-apart distance between aligned/directional air vents 96 may be different from the shown. The hose terminal end fittings 90 and 94 shown in FIGS. 7 and 8, and the Y-shaped end fitting 26 shown in FIG. 1, are merely representative of a variety of hose terminal end fittings that may be used with air discharge hose 24, and hose terminal end fittings 90, 94, and 26 are not intended to represent the entire scope of devices that could be used to direct or adjust the flow of cool air from air discharge hose 24 into a targeted space in need of cooling.

What is claimed is:

1. A spiral vapor pump which when used in combination with a fan, compressor, evaporator, air discharge hose, battery, and magnetic control module can provide the compression needed for maintaining a refrigeration cycle, said spiral vapor pump comprising:

a block assembly with opposite ends, two centrally-located drive access holes in opposed positions from one another, two suction inlet holes, and two discharge outlet holes;

a magnetic assembly associated with each of said opposite ends that is configured, positioned, and connected to a magnetic control module so as to create a magnetic pulse;

an internal cylinder configured and sized for positioning within said block assembly, said internal cylinder having a different intake port configured and positioned for fluid communication with each of said suction inlet holes in said block assembly, said cylinder further having a different discharge port configured and positioned for fluid communication with each of said discharge outlet holes in said block assembly, and said cylinder also having two centrally-located drive ports in opposed positions from one another that are each configured and positioned for communication with a different one of said drive access holes in said block assembly;

a piston configured and positioned for rotation within said internal cylinder to substantially fill said internal cylinder, said piston having a different arcuate drive slot configured and paired for communication with each said drive port in said internal cylinder, said piston also configured and positioned for back-and-forth floating rotation within said cylinder approximately 180-degrees that is capable of alternately aligning said compression slots in said piston with said suction inlet holes and said discharge outlet holes in said cylinder to effect suction and discharge functions at differing times;

at least two compression rings configured and positioned to define and isolate two locations between said piston and said cylinder in which compression occurs to create very highly-compressed vapor; and drive means adapted for movement within said arcuate drive slots of said floating and rotating piston that guides said piston during 180-degree back-and-forth rotation within said internal cylinder, wherein when said magnetic pulse created by said magnetic assemblies initiates rotation of said piston, vapor in said spiral vapor pump becomes highly compressed and is then forcefully discharged into said condenser, and subsequently through a metering device and evaporator, after which said vapor returns to said spiral vapor pump for another compression event.

2. The portable cooling unit of claim 1 wherein said drive means comprises a drive ball, a drive spring, and a drive cover for each said drive port.

3. The portable cooling unit of claim 1 wherein said block housing is made from aluminum and said piston is made from steel.

4. The portable cooling unit of claim 1 wherein said block assembly further comprises a U-shaped cylinder housing, a cover plate, two head plates, and gasket material.

5. The portable cooling unit of claim 1 wherein said U-shaped cylinder housing, said cover plate, said head plates, and said gasket material each further comprises a plurality of fastener holes.

6. The portable cooling unit of claim 1 wherein said evaporator is a ring fin evaporator.

* * * * *